United States Patent [19]

Clifford et al.

[11] 3,964,153

[45] June 22, 1976

[54] METHOD FOR TRANSFERRING YARN PACKAGES FROM A WINDING TUBE TO A CORE FOR DYEING

[75] Inventors: Graham Frank Clifford, Stanley, N.C.; Mack W. Spurrier, Clover, S.C.

[73] Assignee: Gaston County Dyeing Machine Company, Stanley, N.C.

[22] Filed: Feb. 21, 1975

[21] Appl. No.: 551,760

Related U.S. Application Data

[62] Division of Ser. No. 443,629, Feb. 19, 1974, Pat. No. 3,899,817.

[52] U.S. Cl. ..... 29/427; 29/450; 29/458; 29/235; 8/155

[51] Int. Cl.² ..... D06B 3/04; D06B 5/16; B23P 11/02; B23P 19/02

[58] Field of Search ..... 29/427, 200 D, 234, 29/235, 282, 458, 450, 252; 28/1 R, 75; 68/189; 8/155; 279/2 A

[56] References Cited

UNITED STATES PATENTS

| | | | |
|---|---|---|---|
| 1,652,992 | 12/1927 | Krantz | 29/427 UX |
| 2,682,103 | 6/1954 | Hamiltcn | 29/427 UX |
| 2,736,184 | 2/1956 | Harvey et al. | 68/205 |
| 2,736,955 | 3/1956 | Fuglie | 29/427 UX |
| 3,341,930 | 9/1967 | Belanger | 29/427 X |
| 3,425,110 | 2/1969 | Willis | 28/75 |
| 3,681,007 | 8/1972 | Girard | 8/155 |
| 3,833,974 | 9/1974 | Girard | 28/1 R |

FOREIGN PATENTS OR APPLICATIONS

| | | | |
|---|---|---|---|
| 1,153,712 | 9/1963 | Germany | 68/189 |

*Primary Examiner*—Charlie T. Moon
*Attorney, Agent, or Firm*—Richards, Shefte & Pinckney

[57] ABSTRACT

A method, and means for use in performing the same, are disclosed by which a core tube on which a yarn package has been wound may be readily removed while concurrently replacing the removed winding tube with a core suitable for dyeing. An expandable and reciprocable chuck is operated cyclically for this purpose in relation to a plate member on which the yarn package is manually placed for the core removal and dye core replacement. In certain circumstances the method and means disclosed are also adapted for removing the dye core after dying and replacing it with a tube of the sort initially used for winding.

6 Claims, 11 Drawing Figures

10
12
14
16
18
20
22
24
26
28
30
32
34
36
68
76
2

Fig. 5
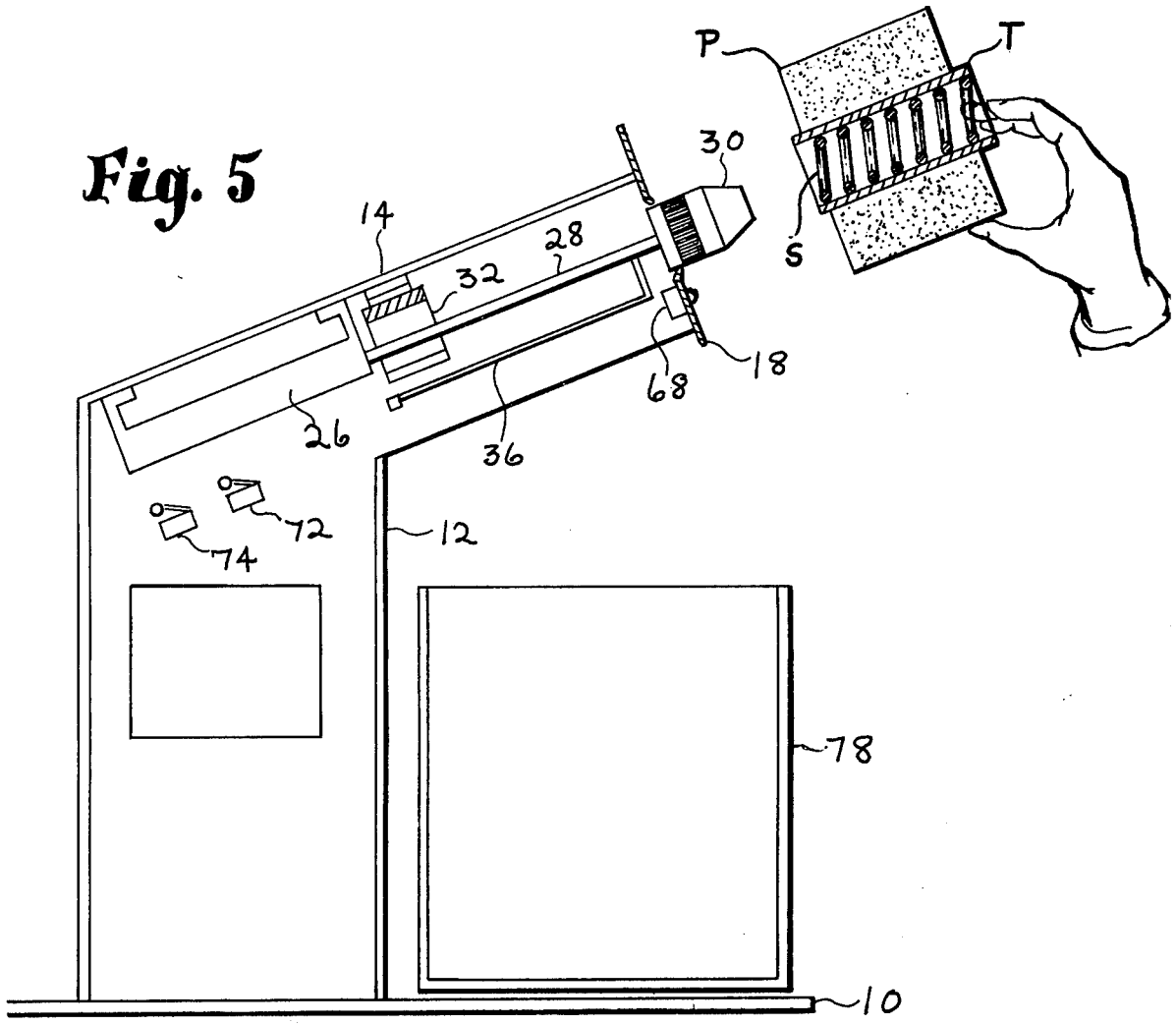
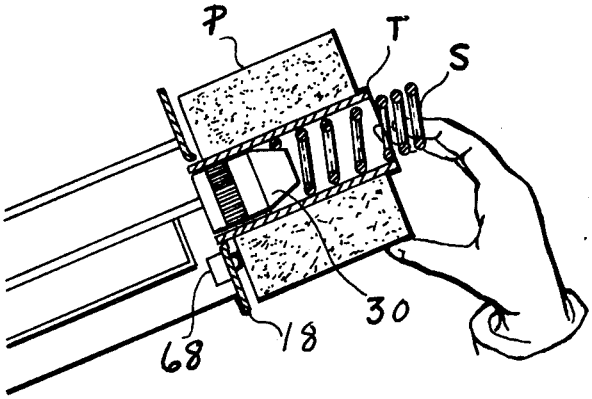
Fig. 6
Fig. 7
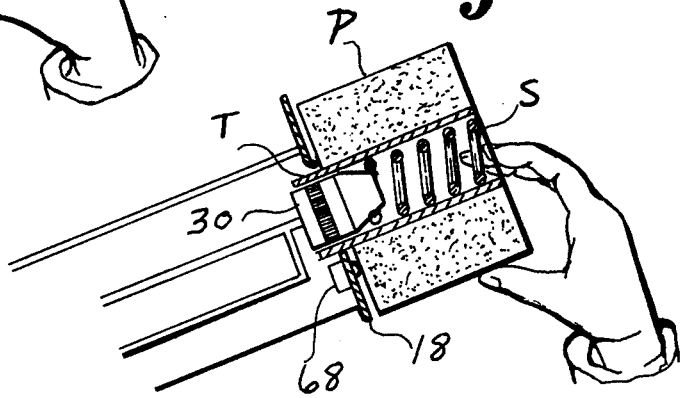

METHOD FOR TRANSFERRING YARN PACKAGES FROM A WINDING TUBE TO A CORE FOR DYEING

CROSS-REFERENCES TO RELATED APPLICATIONS

This is a division of copending application Ser. No. 443,629, filed Feb. 19, 1974, now U.S. Pat. No. 3,899,817.

BACKGROUND OF THE INVENTION

When yarn is to be dyed in package form it is necessary to support the yarn packages on some form of perforated or permeable core for the dyeing operation. Sometimes this is done by arranging the packages directly on the spindles of the package dyeing equipment, but for the most part special dye cores are used to support each package before placing them on the dye machine spindles. A variety of dye core forms are employed among which are the so-called dye springs consisting of spiral stainless steel springs perferably having the coils laced in a manner allowing spring compression while controlling maximum spring length. Perforated or slotted tubes of stainless steel, plastic or fortified paperboard are also used.

It is possible to wind yarn onto the dye cores in forming the packages for dyeing, but if this is done it either involves an extra winding operation in preparation for dyeing or it requires that a substantially greater number of the relatively expensive dye cores be provided to accommodate the yarn package inventory normally maintained to supply the dyeing operation. Accordingly, it is common practice to wind the supply packages on inexpensive paper or plastic core tubes and then transfer them to dye cores, without rewinding, in preparation for dyeing so that dye cores are used only during the package dyeing and subsequent drying and off-winding operations and no more are required than is needed to service these operations.

Such transfer is effected by displacing the core tube axially from the yarn package wound thereon while replacing it with a dye core. To facilitate this transfer operation it is customary to employ a core tube initially that is diametrically sized somewhat larger than the dye core that is to replace it for dyeing. This practice also has the advantage of relaxing winding tension adjacent the package center by allowing some contraction onto the dye core, and such contraction is particularly helpful when textured yarns or the like are being handled, as noted in U.S. Pat. No. 3,425,110 which illustrates a package transfer operation of a sort that has been common according to prior practice.

The general trend in equipment for performing the transfer step has been to provide for automatic operation and a number of troublesome problems have been encountered in using such equipment. To begin with, the core tubes employed for winding cannot be depended on for entire dimensional consistency in diameter or length, nor are the yarn packages always correctly positioned on the core tubes by the winding operation, and the result of such imperfections has often been damage to the core tube or transfer failure, either of which results is likely to be accompanied by yarn loss or equipment damage through jamming or both. Comparable problems and results have been encountered because of damage to the projecting ends of the core tubes during handling of the yarn packages after winding until the time comes to prepare them for dyeing, or because of inability of automatic mechanisms to deal acceptably with the core tube dimensional variations that must be expected, or because of difficulties in locating the core tubes accurately enough for proper mechanical mating with the transfer mechanisms. In addition, there have been considerable problems involved in assuring a proper replacement location of the dye cores in the absence of which the integrity of the transferred yarn package is apt to be lost.

Such difficulties are eliminated according to the present invention by a procedure and enabling means that utilizes a significant degree of manual manipulation in a manner that equals or improves the handling rates possible with automatic mechanisms heretofore in use.

SUMMARY OF THE INVENTION

Generally characterized, the present invention involves insertion of the dye cores, usually in manual fashion, within the core tubes carrying the yarn packages to be transferred, and successive manual presentation of the yarn packages and inserted dye cores to an endwise support for the yarn packages at which an expandable and reciprocable chuck is arranged for interiorly gripping a core tube end portion and then withdrawing the core tube from the yarn package while the inserted dye core is manually guided to a proper package supporting position in its place.

The chuck provided for griping and withdrawal of the core tubes is formed with a projecting nose portion that provides for reshaping damaged core tube ends as they are presented for withdrawal, or rejects the yarn package involved if the damaged core tube end cannot be reshaped satisfactorily. The gripping and withdrawal is arranged for so that the core tubes are removed without damage and may be recovered readily for reuse. The attendant manual manipulation necessary is accomplished without hazard and at a fully acceptable handling rate as already indicated.

DESCRIPTION OF THE DRAWINGS

FIGS. 5 through 11 are sequential diagrammatic illustrations of the package transfer operating sequence.

DETAILED DESCRIPTION OF THE INVENTION

Figures 1, 2:
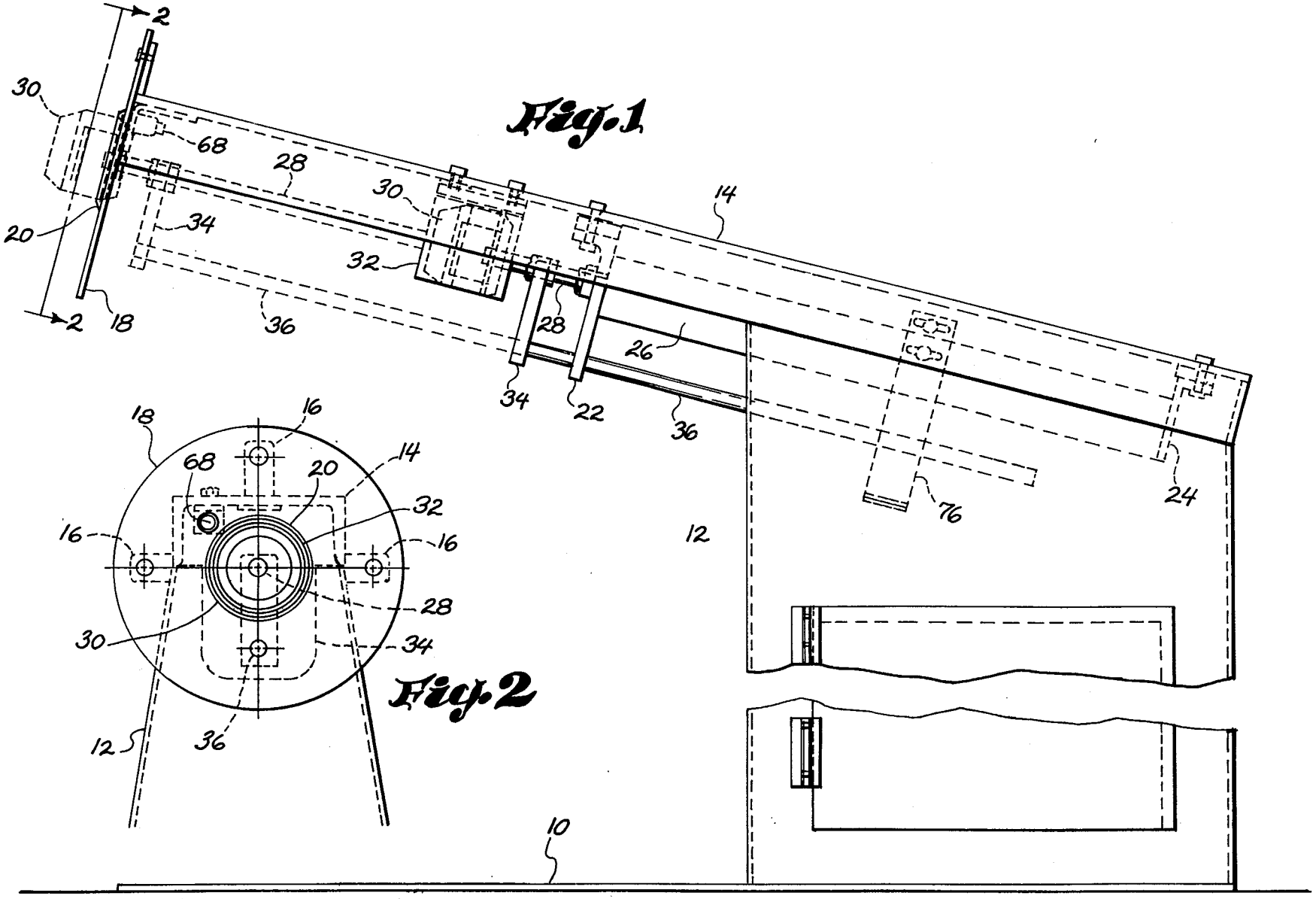
FIG. 1 is a side elevation of representative package transfer means embodying the present invention.
FIG. 2 is a partial end view from the position indicated by the line 2—2 in FIG. 1.

FIG. 1 of the drawings shows the means representatively provided according to the present invention for performing the package transfer operation to include a stabilizing floor plate 10 from the rear portion of which a frame standard 12 rises in a manner forming a cabinet enclosure for control system components and providing a support at its upper end for an inverted channel member 14 (compare FIGS. 1 and 2) that extends therefrom above the front portion of floor plate 10 at an upwardly inclined disposition.

At its forward end (i.e., the end to the left in FIG. 1), the channel member 14 is fitted with three bracket elements 16 at which a yarn package support plate 18 is attached in perpendicular relation. This support plate 18 is proportioned for endwise support of a yarn package while being apertured for clearing a core tube carrying the same. In the illustrated embodiment, the support plate 18 is circular and is centrally apertured with a shallow flanged rim (as indicated at 20 in FIGS. 1 and 2) formed at the aperture periphery so as to stand out from the package supporting face of plate 18.

Rearwardly of channel member 14 spaced mounting brackets 22 and 24 are arranged between which a fluid pressure operating cylinder 26 is carried so as to dispose a piston rod 28 extending forwardly therefrom in axial alignment with the central aperture in support plate 18. The piston rod 28 carries a chuck 30 at its extending end and the cylinder 26 is operated, as noted in detail further below, to reciprocate the chuck 30 perpendicularly in relation to support plate 18 between an initial position at which it is extended through the plate member aperture sufficiently for receiving and interiorly gripping an adjacent end portion of a core tube carrying a yarn package supported on plate member 18, and a retracted position at which chuck 30 is withdrawn from such extension sufficiently to space it from plate member 18 in excess of the axial length of the core tube. At retracted position, the chuck 30 is withdrawn within a tubular stripping cylinder 32 attached within channel member 14 and slotted at its bottom to clear movement of a downwardly extending bracket arm 34 mounted on the cylinder piston rod 28 behind chuck 30 to carry a rearwardly extending operating control rod 36.

Figure 3:
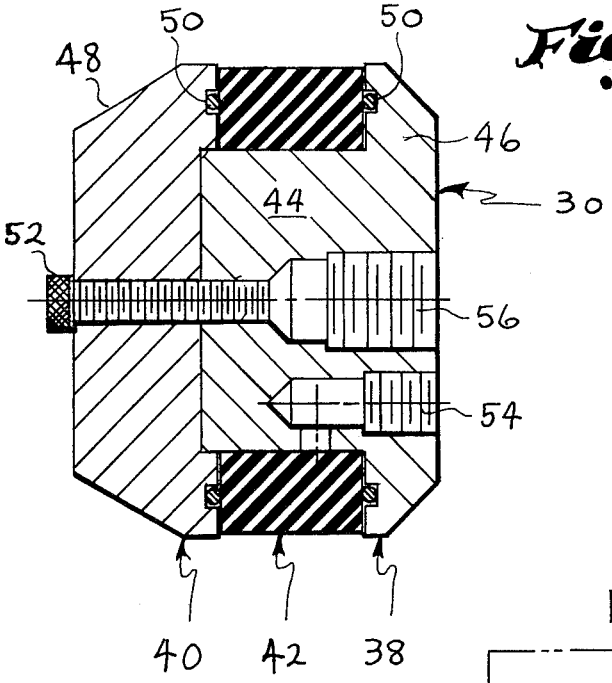
FIG. 3 is a central section detail of the expandable chuck employed in the FIG. 1 means.

The form of chuck 30 is illustrated more particularly in FIG. 3 as comprising a composite and generally cylindrical body having a base component 38, a cap component 40, and a resilient gripping component 42 of annular form. The base component 38 has a principal cylindrical portion 44 that is circularly flanged at one end 46. The cap component 40 has a major circular form corresponding in diameter to that of base component flanging 46 and is circularly recessed at one face for located assembly at the unflanged end of base component 38 while a substantial portion of its periphery is beveled (as at 48) toward the other face so as to provide a nose portion for the previously mentioned core tube reshaping purposes. The resilient gripping component, which is suitably formed of rubber, has an inner diameter proportioned for a snug push fit on the base component principal portion 44, an outer diameter corresponding substantially to that of the base component flanging 46, and a width proportioned for snug disposition between the base component flanging 46 and the cap component 40.

Preferably, the opposing faces of the base component flanging 46 and the cap component 40 are annularly grooved and have O-rings 50 seated thereat for sidewise sealing of gripping member 42. The cap component 40 is assembled on base component 38 to contain the interposed gripping component 42 by a single, centrally arranged, cap screw 52 and is thus readily removable for servicing gripping component 42 whenever necessary. The base component 38 is internally channeled at 54 from the flanged end 46 thereof to the lateral face of its principal portion for the application of fluid pressure to expand gripping component 42, and the base component 38 is also centrally bored at 56 for mounting at the extending end of cylinder piston rod 28.

Figure 4:
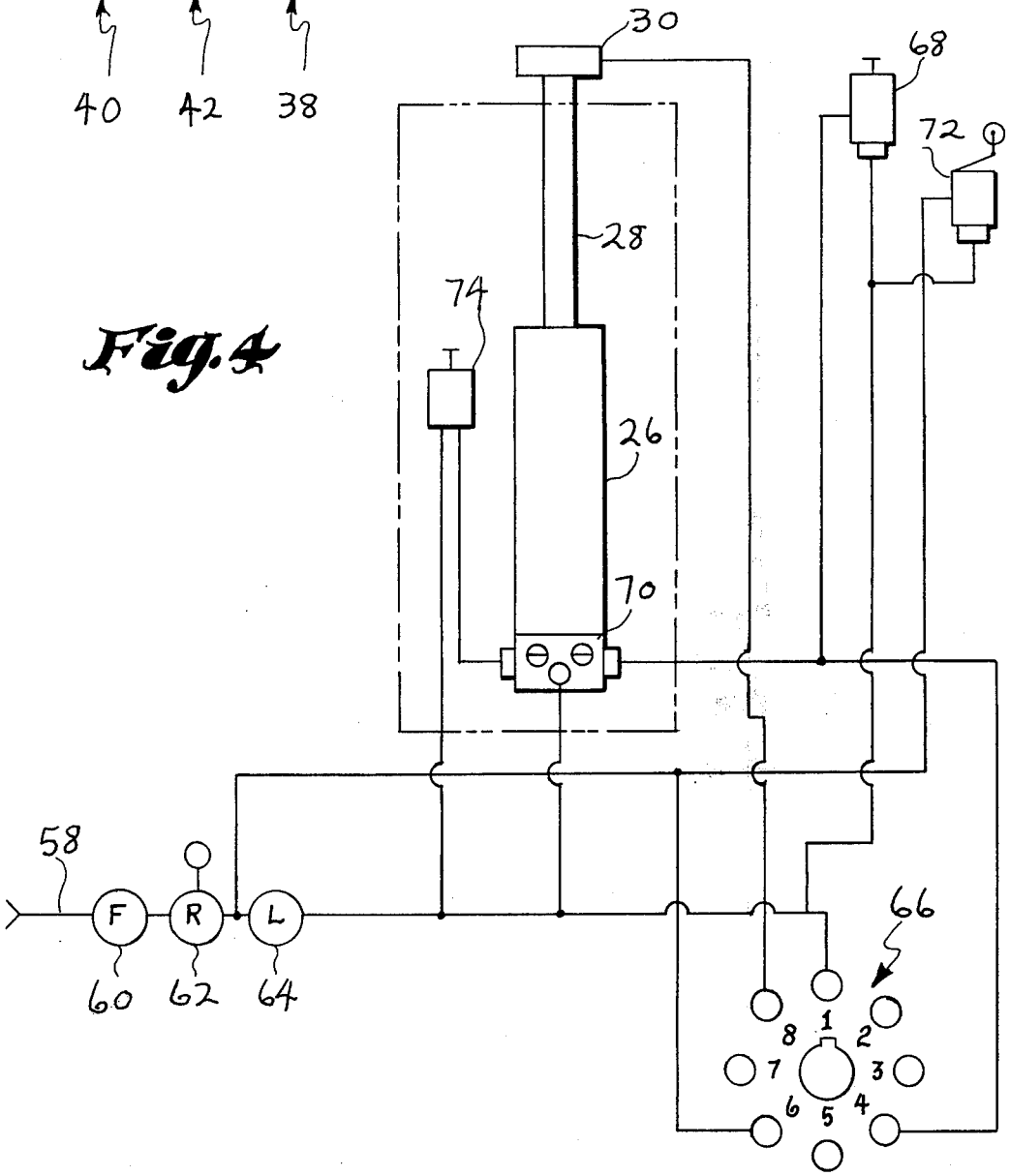
FIG. 4 is a schematic diagram of the air control system used in operating the FIG. 1 means.

The operating control system, in which the motive power is preferably supplied by air, and which is diagrammed in FIG. 4, comprises an air supply line at 58 fitted with a filter at 60, a regulator at 62, and a lubricator at 64, and connected as indicated in relation to a pilot valve 66 with the chuck 30, a chuck actuating valve 68, a directional cylinder control valve 70, a chuck releasing valve 72, and a cylinder reversing valve 74. The chuck actuating valve 68 is push button operated and is located at the yarn package support plate 18, as indicated in FIGS. 1 and 2, to be operated by depression of its push button through endwise contact with a yarn package whenever one is placed on support plate 18 for a core tube transfer operation. The chuck releasing valve 72 is carried on the front mounting bracket 22 for cylinder 26, and the cylinder reversing valve 74 on a special bracket 76 depending from channel 14, with both valves being arranged for sequential operation by the control rod 36 moving with cylinder piston rod 28, as will presently appear more fully.

Operation of the FIG. 4 control system can be reviewed best in connected relation to the sequential illustrations of a transfer operation diagrammed in FIGS. 5 through 11. A transfer operation is commenced, as illustrated in FIG. 5, by an operator manually picking up a yarn package P carried on a core tube T and having a dye spring S (or other dye core) inserted therein. The operator may insert the dye spring S in the course of picking up the yarn package P, or the packages P may be brought to the operator by a suitable chute or conveyor mechanism with the dye springs S already inserted therein. The indicated dye spring S is intended to be one of the laced type previously mentioned because of the advantages obtained therewith and the consequent common use of this type of dye core. However, the operating principle is the same no matter what sort of dye core is employed.

The yarn package P is picked up as illustrated in FIG. 5 so as to hold the inserted dye spring S in place. Usually this can be done with one hand in the illustrated manner. If the package P is so large as to make such handling difficult, the operator's other hand can be additionally employed to support the package laterally as it is placed endwise on the support plate 18 with the adjacent end portion of the supporting core tube T located over the chuck 30. If this core tube end portion has been deformed at all during previous handling, the nose portion 48 of chuck 30 will serve to facilitate reshaping it acceptably in the course of location. This reshaping may require some attention by twisting and axial pressure on the package P and core tube T as they are put in place. Usually they will go in place readily, and if they cannot be put in place by reasonable manipulation the transfer apparatus will simply reject the particular package at hand for separate attention to the damaged core tube T. Also it should be noted that the support plate 18 is apertured for closely spaced clearance of the core tube T (e.g., at not more than about one-eighth inch on the diameter) so that the apparatus will also reject any package P carried by an oversize core tube T.

Figure 8:
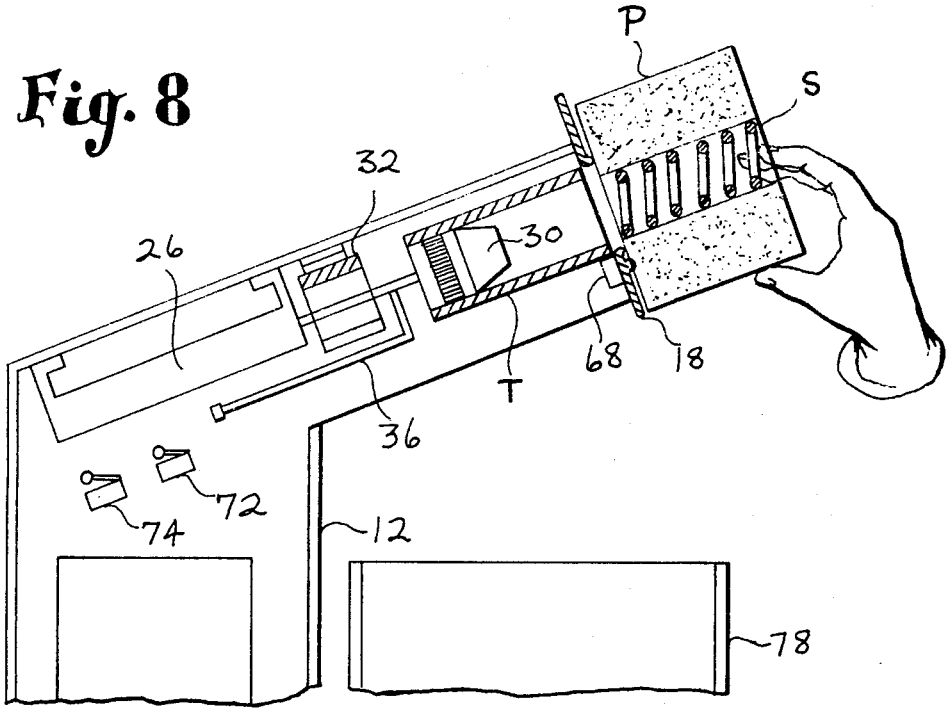

Assuming that the core T carrying the yarn package P at hand can be located satisfactorily over chuck 30, as illustrated in FIG. 6, the result of such location is to bring the package P in endwise contact with the push buttom of clutch actuating valve 68 which causes a shift at this valve that applies supply pressure to the cylinder directional valve 70 and at port No. 4 of the pilot valve 66. Both valves 66 and 70 thereupon shift, with valve 66 applying pressure through port No. 8 to chuck 30 for expanding the gripping component 42 and operating cylinder 26 to cause a nearly simultaneous but slightly delayed withdrawal of chuck 30. In locating the core tube T over the chuck 30, the operator's hand will have allowed the necessary displacement of the inserted dye spring S, as illustrated in FIG. 6, but as the chuck withdrawal commences the operator presses the dye spring S level at the held package end as illustrated in FIG. 7, so that it will assume a proper package supporting position as the core tube withdrawal continues as seen in FIG. 8.

Figure 9:
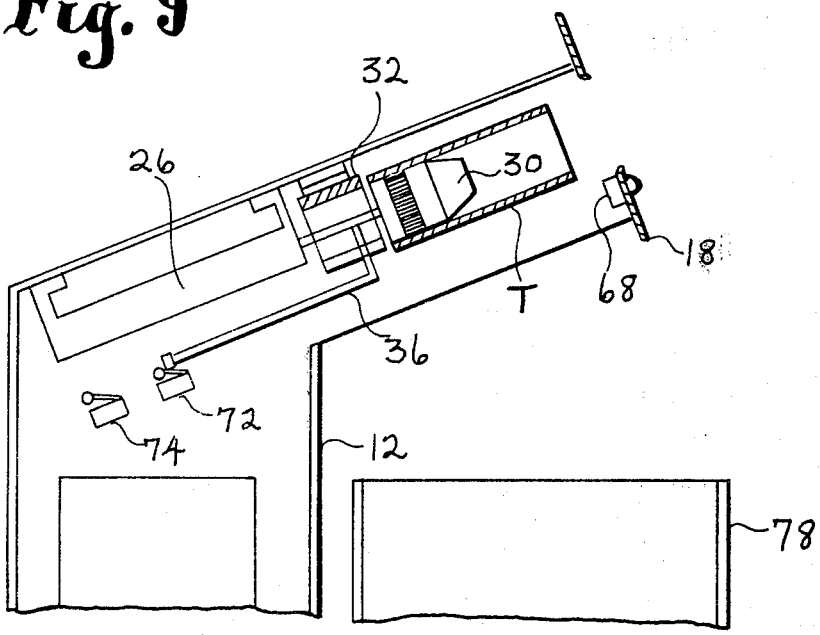
Figure 10:
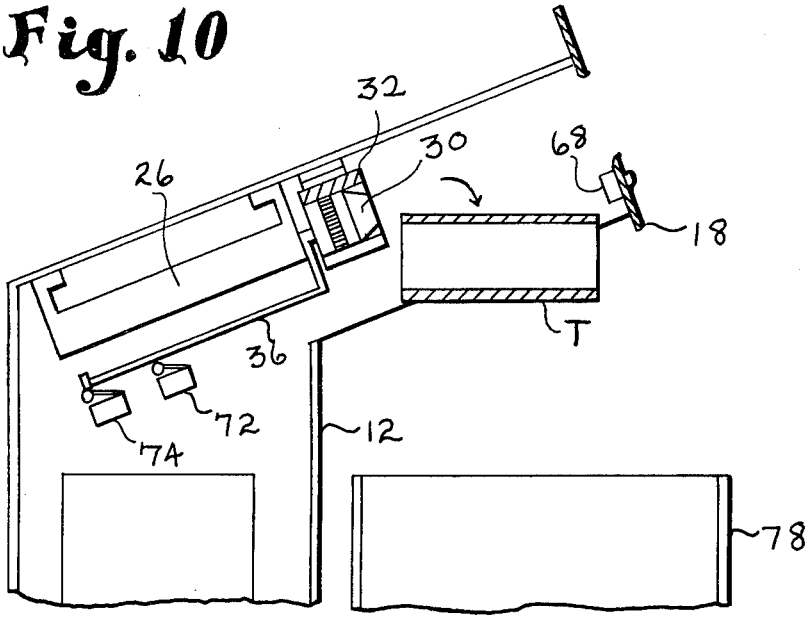
Figure 11:
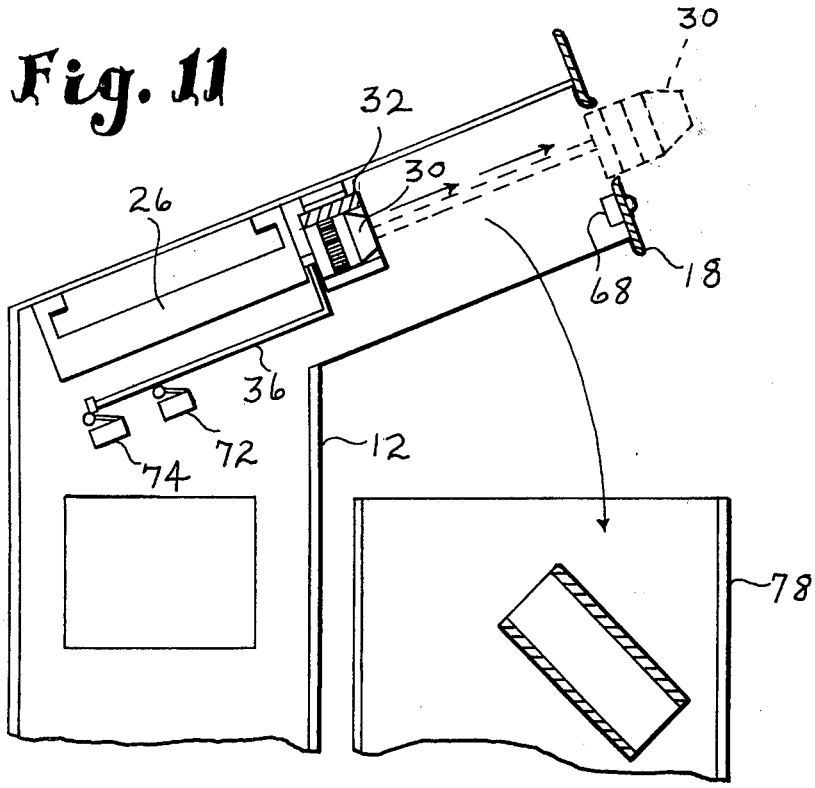

Complete withdrawal of the chuck-gripped core tube T from package P results in bringing the control rod 36 into actuating relation with the chuck releasing valve 72, as indicated in FIG. 9, which operates to direct supply pressure to port No. 6 of pilot valve 66 so as to shift the latter again to release the grip of chuck 30 just prior to its continued withdrawal within stripping cylinder 32 that acts to remove the withdrawn core tube T and allow it to drop clear by gravity for collecton in a suitable recovery bin 78 positioned on the front portion of floor plate 10 in the manner diagrammed by FIG. 10. Then, finally, as chuck 30 withdraws fully within stripping cylinder 32, the control rod 36 additionally actuates the cylinder reversing valve 74 so as to shift the same for returning chuck 30 to its initial position, as indicated in FIG. 11, for a succeeding cycle of operation, and as the operator will be free to remove the transferred package P as soon as the core tube T has been withdrawn he will normally have time to be ready with a new package P and inserted dye spring S each time the operating cycle is completed, so that excellent production rates are possible despite the extent of manual handling involved and there is no real purpose to be served in attempting to automate the operation further.

The transfer operation as performed according to the present invention is applicable in any situation where the core tube T to be removed can be gripped internally and will withdraw endwise from the package P it supports so as to allow replacement by a dye core in preparation for dyeing. In addition, the same operation may be employed for removing the dye core after dyeing whenever it will accommodate internal gripping and is subject to endwise withdrawal, so as to eliminate the off-winding operation and free the dye cores sooner for reuse in dyeing. Thus, in general, the transfer operation of the present invention may be employed effectively for transferring a yarn package from any first core tube to a second one if the first one can be gripped and withdrawn as intended and the second one can be concurrently substituted in package supporting relation adequate to allow satisfactorily whatever following package handling is intended.

The present invention has been described in detail above for purposes of illustration only and is not intended to be limited by this description or otherwise to exclude any variation or equivalent form or procedure that would be apparent from, or reasonably suggested by, the foregoing disclosure to the skill of the art.

We claim:

1. The method of transferring a yarn package from a core tube on which it has been wound to a core suitable for supporting the package for dyeing, which method comprises inserting the dye core within the winding tube having said package wound thereon, supporting said package endwise with an end portion of said winding tube at the supported package end located over an expandable and reciprocable chuck while maintaining the dye core free of said chuck, and then causing said chuck to grip said winding tube interiorly and withdraw the same from the supported package while concurrently causing the dye core to assume a proper supporting position within the package.

2. The method defined by claim 1 wherein the insertion of said dye core is done manually, wherein said chuck is caused to grip and withdraw said winding tube by manually placing said package so that it is supported with a winding tube end portion located over said chuck, and wherein said dye core is manually caused to assume a proper package supporting position upon withdrawal of said winding tube.

3. The method defined by claim 1 wherein said chuck is further caused to release said winding tube following withdrawal thereof and then return to its initial position for location of a succeeding winding tube end portion thereover.

4. The method defined by claim 3 wherein the withdrawn winding tube is stripped from said chuck upon release and is allowed to fall clear by gravity.

5. The method defined by claim 1 wherein the recited method steps are repeated after dyeing for removing said dye core and replacing the same with a tube core of the sort initially used for winding the package.

6. The method of transferring a yarn package from a first supporting core to a second one sized diametrically for insertion within the package, which method comprises supporting said package endwise with an end portion of the first core at the supported package end located over an expandable and reciprocable chuck while maintaining the second core free of said chuck, and then causing said chuck to grip said first core interiorly and withdraw the same from the supported package while concurrently causing the second core to assume a proper supporting position within the package.

* * * * *

Dedication 3,964,153.—*Graham Frank Clifford*, Stanley, N.C., and *Mack W. Spurrier*, Clover, S.C. METHOD FOR TRANSFERRING YARN PACKAGES FROM A WINDING TUBE TO A CORE FOR DYEING. Patent dated June 22, 1976. Dedication filed June 10, 1977, by the assignee, *Gaston County Dyeing Machine Company.*

Hereby dedicates to the Public the remaining term of said patent.

[*Official Gazette August 2, 1977.*]